US005103781A

United States Patent [19]

Scott et al.

[11] Patent Number: 5,103,781

[45] Date of Patent: Apr. 14, 1992

[54] AUTOMATIC CHOKE AND STARTING AID FOR SMALL TWO-CYCLE INTERNAL COMBUSTION ENGINES

[75] Inventors: William A. Scott, Mt. Zion; Mark A. Hutchinson; Gary L. Baumbarger, both of Decatur, all of Ill.

[73] Assignee: Tillotson Ltd., Decatur, Ill.

[21] Appl. No.: 611,128

[22] Filed: Nov. 9, 1990

[51] Int. Cl.[5] ..... F02M 1/02

[52] U.S. Cl. ..... 123/179.18; 261/64.6

[58] Field of Search ..... 123/179 G, 179 A, 179 C; 261/64.6

[56] References Cited

U.S. PATENT DOCUMENTS

| | | | |
|---|---|---|---|
| 909,897 | 1/1909 | Hertzberg | 123/179 G |
| 1,003,994 | 9/1911 | Dennis | 261/64 C |
| 1,019,160 | 3/1912 | Ivor | 261/54 |
| 1,161,437 | 11/1915 | Beamer et al. | 261/64.6 |
| 1,194,297 | 8/1916 | Kingston | 261/64 C |
| 1,324,515 | 12/1919 | Otti | 261/64 |
| 1,346,201 | 7/1920 | Hays | 261/64 C |
| 1,591,331 | 7/1926 | Linebarger . | |
| 2,356,063 | 8/1944 | Jorgensen et al. | 123/179 A |
| 2,717,150 | 9/1955 | Agar | 261/64.6 |
| 2,793,634 | 5/1957 | Ericson | 123/179 A |
| 2,969,785 | 1/1961 | Fuchs et al. | 123/179 A |
| 3,177,920 | 4/1965 | Phillips . | |
| 3,275,305 | 9/1966 | Nutten | 261/34 |
| 3,494,343 | 2/1970 | Nutten | 123/187.5 R |
| 4,123,233 | 10/1978 | Mannino | 48/180 C |
| 4,335,061 | 6/1982 | Kobayashi | 261/44 G |
| 4,447,370 | 5/1984 | Kobayashi et al. | 261/35 |
| 4,684,484 | 8/1987 | Guntly | 261/35 |
| 4,684,485 | 8/1987 | Scott | 261/35 |
| 4,711,744 | 12/1987 | Scott et al. | 261/64.4 |
| 4,793,951 | 12/1988 | Scott | 261/35 |
| 4,948,536 | 8/1990 | Scott et al. | 261/64.4 |

FOREIGN PATENT DOCUMENTS

| | | | |
|---|---|---|---|
| 1262671 | 3/1968 | Fed. Rep. of Germany | 261/64.6 |
| 551039 | 3/1923 | France . | |
| 1-142251 | 6/1989 | Japan | 261/64.6 |
| 162496 | 5/1921 | United Kingdom . | |
| 2188679 | 10/1987 | United Kingdom . | |

*Primary Examiner*—Andrew M. Dolinar
*Attorney, Agent, or Firm*—Harness, Dickey & Pierce

[57] ABSTRACT

An automatic choke assembly or starting aid is coupled with a small internal combustion engine. The choke assembly is responsive to a pressure differential in the internal combustion engine which causes movement of a mechanism to control the amount of combustion air entering into the internal combustion engine. The mechanism provides sufficient combustion air during start-up and during continuous running condition of the internal combustion engine.

6 Claims, 2 Drawing Sheets

AUTOMATIC CHOKE AND STARTING AID FOR SMALL TWO-CYCLE INTERNAL COMBUSTION ENGINES

BACKGROUND AND SUMMARY OF THE INVENTION

The present invention relates to chokes and starting aids for small internal combustion engines and, more particularly, to a choke and starting aid which enhances cold starting, cold run and flooded starting conditions.

When starting small internal combustion engines, it is usually necessary to pull on the starter rope several times before the engine kicks over and begins to run. Generally, after a couple of pulls on the starter rope, the engine starts and runs for a short period of time and then stops. This "false start" phenomenon has been present in the chain saw art for several years and has come to be accepted by users of such saws as an acceptable starting method. The user generally has knowledge of the fuel system procedure and understands why the system is not starting.

The difficulty in starting a cold small internal combustion engine centers around the choke system of these particular engines. When the choke system is in a closed position, the fuel line system of a cold engine has a very high restriction in the air intake. This restriction of the air intake forms a vacuum in the fuel line, sucking fuel into the engine, via the carburetor, from the fuel tank. Also, a fuel bulb or the like may be coupled with the engine to force the fuel into the carburetor. Two such fuel bulb systems are illustrated in U.S. Pat. Nos. 4,793,951 (issued Dec. 27, 1988) and 4,684,485 (issued Aug. 4, 1987), both assigned to the assignee of the present application, the specifications of which are expressly incorporated by reference.

As the starting rope is pulled, the engine sucks fuel into the carburetor by the vacuum created in the system. As the engine begins to fire, a certain amount of air is necessary to keep the engine running. With a manual choke, the user must open the choke quickly after the engine begins to run or the user will experience the "false start" phenomenon. The reason for the "false start" is that as the speed of the engine increases, the engine sucks more fuel. With the choke in a closed position, however, the amount of air flow entering the engine is not increased. Thus, a proper mixture of air and fuel is not achieved and the engine dies instantly. Also, if the engine does not start, a substantial amount of fuel is sucked into the engine, via the carburetor, causing the engine and carburetor to become flooded, further hampering the starting procedure of the engine.

Choke devices presently used in the field are of a butterfly type. These types of chokes are pivotally secured in the carburetor air port of an internal combustion engine. The choke usually pivots about a central axis, rotating from a closed to an open position. This type of choke assembly has several disadvantages. When starting the engine the choke is in the fully closed position. Once the engine starts, it is nearly impossible to rotate the choke to its open position, so that the engine will continue to run. Also, the butterfly valve may move from a closed to an open position without notice to the user. This slippage is due to the fact that, in many instances, there is no resistance member holding the butterfly valve in position. Those skilled in the art are aware of yet other disadvantages of this type of choke assembly.

Another type of choke device that is present in the art is disclosed in U.S. Pat. No. 4,711,744 issued Dec. 8, 1987 to the assignee of the present invention, the specification of which is expressly incorporated by reference. This type of device works well in monitoring the amount of air entering into the internal combustion engine.

Another type of automatic choke device that is present in the art is disclosed in U.S. Pat. No. 4,948,536, issued Aug. 14, 1990, to the assignee of the present application, the specification of which is expressly incorporated by reference. This device works well to provide sufficient combustion air during start-up and continuous run conditions, however, designers are always striving to improve the art.

Accordingly, it is an object of the present invention to overcome the disadvantages of the above art. The present invention provides the art with a new and improved choke assembly which enables air to automatically enter the carburetor during start-up of an internal combustion engine to provide a continuous running situation. The present invention includes a mechanism responsive to pressure differentials in the internal combustion engine which, in turn, controls the amount of air entering into the engine. The present invention provides the automatic choke to be in a choked condition with the throttle in a partially open condition at cold start-ups. Also, the present invention provides the automatic choke to be in an open position with the throttle in a wide open condition to enhance starting in a flooded or hot restart condition. The present invention provides a one piece starting aid which partially restricts the air flow during cold start-ups.

From the subsequent description and the appended claims taken in conjunction with the accompanying drawings, other objects and advantages of the present invention will become apparent to those skilled in the art.

DETAILED DESCRIPTION OF THE PREFERRED EMBODIMENT

Figure 1:
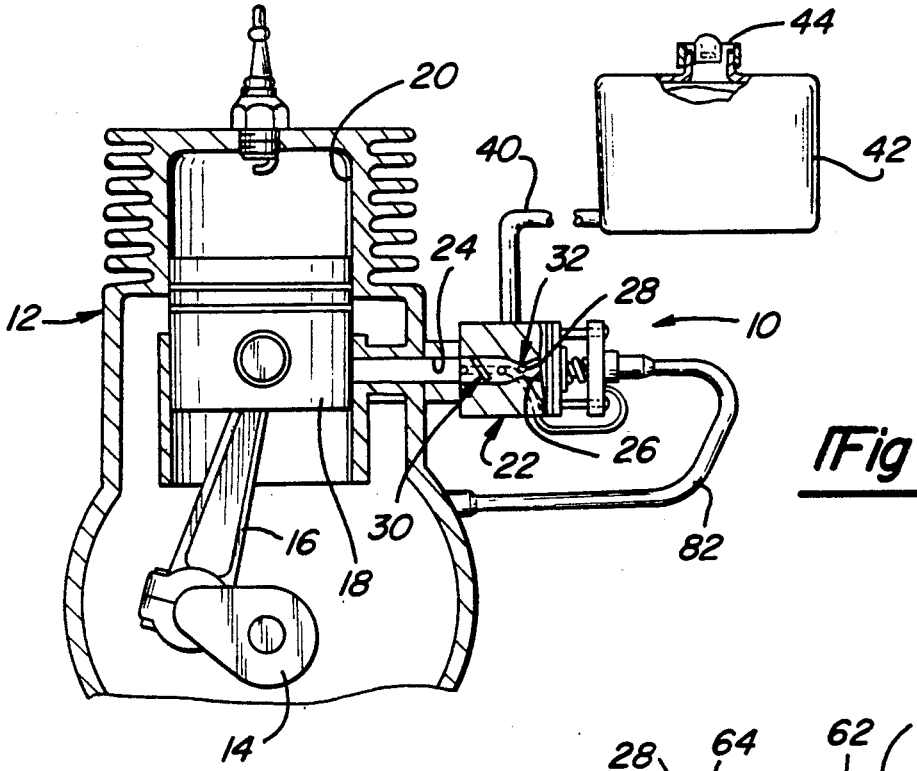
FIG. 1 is a side elevational view partially in cross section of a small internal and combustion engine having a choke assembly or starting aid in accordance with the present invention.

Referring to FIG. 1, a choke assembly or starting aid is shown in combination with the carburetor of an internal combustion engine and designated with the reference numeral 10. The choke assembly 10 is coupled with an internal combustion engine 12. Internal combustion engine 12 includes a crankshaft 14 having a piston rod 16 secured to it. Piston rod 16 has a piston head 18 which is slidably positioned in the piston cylinder 20 in the internal combustion engine 12. A carburetor 22 is coupled with the internal combustion engine 12 and is in communication with the piston cylinder 20 via a carburetor bore 24. The carburetor 22 provides a combustible air/fuel mixture to the piston cylinder 20 for driving the internal combustion engine 12. The carburetor 22 is in communication with an air inlet manifold 26 which, in turn, is in communication with a source of combustion air, preferably atmospheric air. The choke assembly 10 is generally coupled with the air manifold 26 of the carburetor 22 of the internal combustion engine 12.

The carburetor 22, preferably of the diaphragm type, has a fuel inlet port 28 to provide fuel to the piston cylinder 20 for combustion in the piston cylinder 20. Carburetor 22 also has a throttle valve 30 to control the amount of air/fuel mixture which enters into the piston cylinder 20. Throttle valve 30 is pivotally positioned in the carburetor bore 24. A venturi 32 is formed in the carburetor bore 24 to enable the air/fuel mixture to move more rapidly into the piston cylinder 20.

The inlet air manifold 26 is generally adjacent to and in communication with the carburetor bore 24. Combustion air is drawn through the inlet air manifold 26 to supply combustion air into the piston cylinder 20, via the carburetor 22.

As also seen in FIG. 1, the fuel inlet port 28 is coupled with a fuel line 40 which, in turn, is coupled with a fuel tank 42. The fuel tank 42 has a rotatable, removable cap 44 which includes an atmospheric vent.

The choke 10 includes a housing 60, ordinarily two pieces, defining a cavity 62. The housing 60 has one or more support members 64 to secure and position the housing 60 with the carburetor 22. The support members 64 are such that a gap or inlet 66 is formed between the carburetor air manifold 26 and the housing 60.

A diaphragm 68 is operatively secured by the housing 60 within the cavity 62. The diaphragm 68 moves in response to pressure differentials in the internal combustion engine 12. A plunger 70 is secured to the diaphragm 68. The plunger has a neck 72 directly connected to the diaphragm 68 and a planar head 74 adapted to cover the carburetor air manifold 26. A calibrated spring 76 is positioned about the periphery of neck 72 to provide resilient resistance against the diaphragm 68. The spring 76 returns the plunger 70 to a position covering the carburetor air manifold 26 after the engine has been stopped. An inlet 80 enables a pressure differential to enter into the cavity 62, via conduit 82. The inlet 80 is coupled with a one way valve 84 between the inlet 80 and conduit 82. The one way valve 84 prevents positive pressure from entering into the cavity 62. Also, the housing 60 includes a nipple 86 which enables the conduit 82 to be secured to the housing 60.

The housing 60 has a venting system 90 which includes a vent port 92 associated with the cavity 62. The vent port 92 has a calibrated orifice to enable venting of the cavity 62. A conduit 94 is coupled with the vent port 92 and, at its other end, is coupled with a passage 96 in the carburetor 22.

The carburetor 22 includes a nipple 95 or the like to receive the end of conduit 94. Passage 96 is formed in carburetor 22 with one end 97 open to atmosphere. The passage 96 is separated into two sections by a rotatable throttle shaft 98. The throttle shaft 98 includes a passage 100. The passage 100 is enabled to be positioned in and out of alignment with passage 96. When alignment occurs, the cavity 62 is vented to atmosphere via vent port 92, conduit 94 and passage 96.

Figure 2:
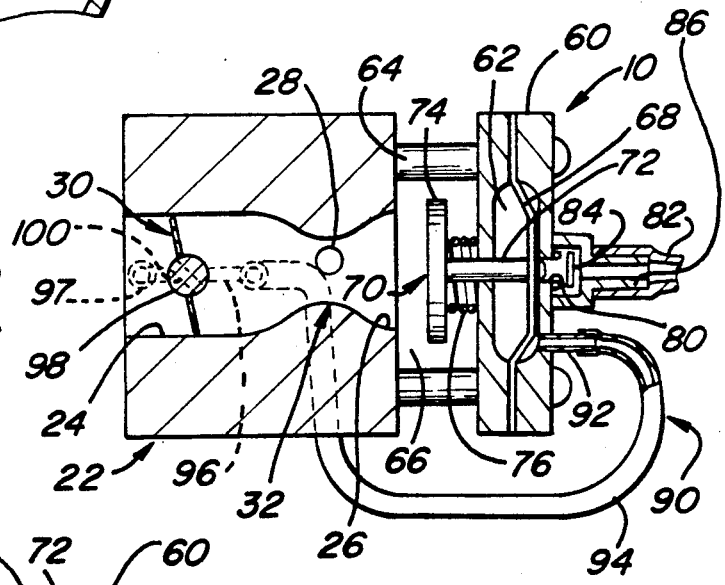
FIG. 2 is an enlarged sectional view of the choke assembly or starting aid in FIG. 1 with the throttle in a closed position.
Figure 3:
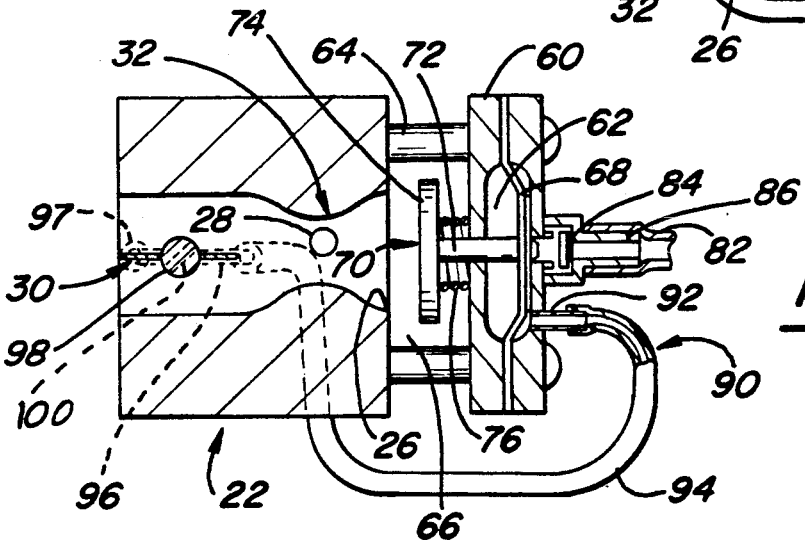
FIG. 3 is a sectional view like FIG. 2 with the throttle in a wide open position.

When the engine is running at idle, the throttle 30 is nearly closed, as illustrated in FIG. 2. During this condition, the throttle shaft passage 100 is out of alignment with passage 96 and the cavity 62 is closed to atmosphere. Also, the diaphragm 68 is in a retracted position covering the vent port 92. Likewise, during running at a wide open condition of the throttle 30, as seen in FIG. 3, the shaft passage 100 is out of alignment with passage 96 and again cavity 62 is closed to atmosphere.

Figure 4:
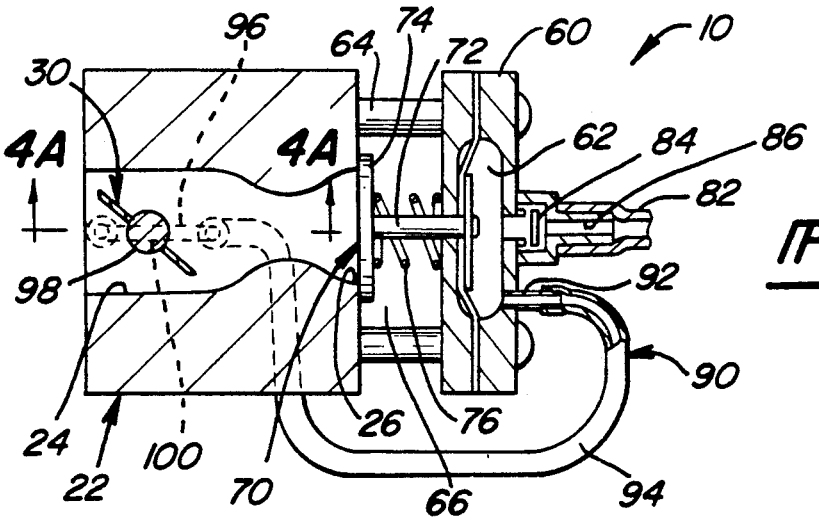
FIG. 4 is a sectional view like FIGS. 2 and 3 with the throttle in a partially open position.
Figure 4A:
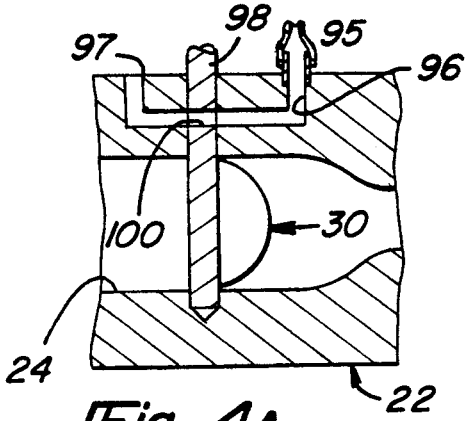
FIG. 4A is a sectional view of FIG. 4 along line 4A thereof.

The cold internal combustion engine 12 is started as follows. The operator compresses on the primer bulb 46, if one is present, turns on the ignition, if necessary, and turns the throttle valve 30 to a partial throttle position as seen in FIG. 4, which may be accomplished by locking the trigger (not shown) of the apparatus, such as a chainsaw, in its partial throttle position with the shaft passage 100 in alignment with passage 96 venting the cavity to atmosphere as seen in FIG. 4A. While the throttle valve 30 is partially open, the starter rope of the apparatus would be pulled several times (approximately three to four pulls). During these three or four pulls, the plunger 70 will remain covering the carburetor air manifold 26. During the initial pull of the starter rope, the crankcase vacuum at the diaphragm 68 is approximately 1 inch of mercury. Once the engine fires and begins to run, the crankcase vacuum increases to about 2 inches of mercury or an increase in vacuum of a ratio of about 2 to 1. As the vacuum increases in the crankcase, the diaphragm 68 is pulled away from the one side of the cavity 62 to the opposite side of the cavity. As this occurs, the plunger 70 is lifted away from the carburetor air manifold 26 as seen in FIGS. 2 and 3. The vacuum enables the choke to work automatically such that when the starter rope is initially pulled, sufficient combustion air is present during start-up of the internal combustion engine. After the engine begins to run, the diaphragm 68 automatically draws against the top of the cavity 62, as seen in FIGS. 2 and 3, to enable sufficient combustion air to enter the internal combustion engine during continuous operation of the engine.

Also during running conditions after the engine heats up, the vacuum in conduit 82 overcomes the calibrated orifice in vent port 92 and retracts diaphragm 68 while the throttle 30 is in partially open condition, as shown in FIG. 4. Once the engine is running, the trigger (not shown) of the apparatus may be unlocked and may move between an idle position (FIG. 2), and a wide open position (FIG. 3), where the throttle shaft 98 is rotated such that shaft passage 100 is out of alignment with passage 96 closing the vent port 92.

Approximately 15 minutes after the engine has run and is shut down, the diaphragm carburetor percolates fuel due to a heat soak return, which fuel enters the engine crank case causing a flooded condition. To restart a flooded engine it is desirable to have as much combustion air present as possible.

Thus, it is desirable to have the throttle 30 in a wide open condition allowing the maximum amount of air into the carburetor. Since the engine is "hot", the vacuum in the crank case is high enough to retract the plunger 70 from the manifold 26, as seen in FIG. 3. With the trigger (not shown) of the apparatus in a wide open condition, with the plunger 70 retracted, the carburetor bore 24 is unobstructed to enable maximum air flow to enter the engine during "hot" restart or flooded conditions. Thus, a few pulls on the starter rope in this condition will start a flooded engine.

Figure 5:
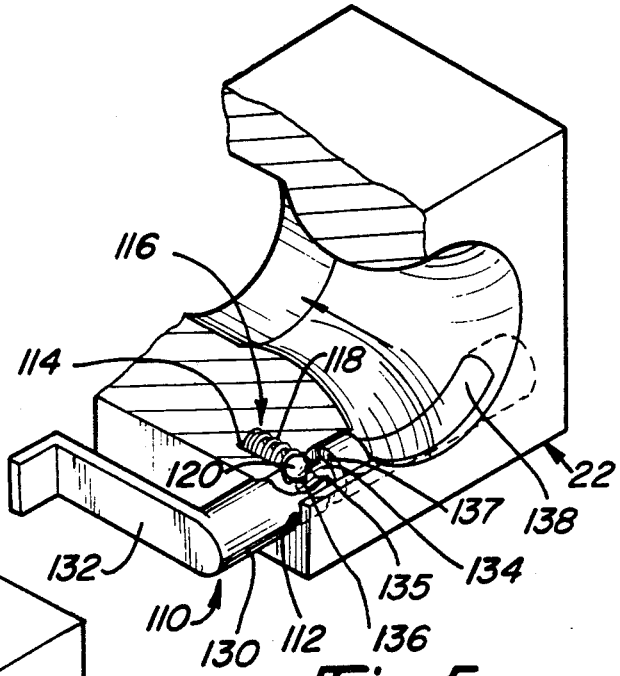
FIG. 5 is a perspective view partially in section of a carburetor body and starting aid in accordance with the present invention.
Figure 6:
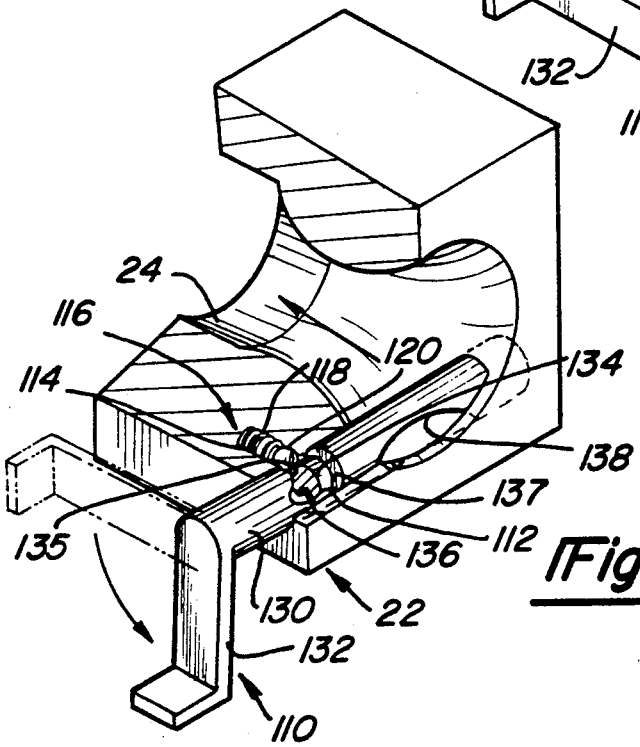
FIG. 6 is a view like that of FIG. 5 with the starting aid rotated 90 degrees.

Turning to FIGS. 5 and 6, another embodiment of the present invention is shown. A starting aid 110 is illustrated with the carburetor body 22 with the choke assembly 10 removed.

The carburetor body 22 includes a bore 24 with air flow in direction of the arrow. The carburetor body 22 includes bores 112 and 114 to house the one piece starting aid 110. The bore 112 is disposed transversely to bore 24 and has a portion open to enable starting aid 110 to selectively project into the bore 24. Bore 114 is positioned parallel with bore 24 and perpendicular to and intersecting bore 112.

A retaining mechanism 116 is positioned in bore 114 to retain and position the starting aid 110. The retaining mechanism 116 includes a helical spring 118 and a ball 120 to retain and position the starting aid 110 in the carburetor body 22.

The starting aid 110 includes a shaft 130 and handle 132. The shaft 130 is positioned in bore 112 and rotatably maintained therein by retaining mechanism 116. The shaft 130 has a circumferential annular groove 134 with a V-shaped notch detent 136 in the surface of groove 134. The groove 134 and V-shaped notch 136 cooperate with the retaining mechanism 116 to retain and position the one piece starting aid 110 in the carburetor body 22. Side walls 135 and 137, which define the boundaries of annular groove 134, are substantially perpendicular to the shaft axis and abut the ball 120, as seen in FIG. 5, to prohibit lateral movement of the shaft 130 in bore 112. The shaft 130 also includes an arcuate cutout portion 138 which cooperates with the bore 24 as explained herein.

The V-shaped notch 136 enables ball 120 to be positioned therein to effectively lock the shaft 130 in a first position against rotation during operation of the engine as seen in FIG. 5. In the locked position, arcuate cutaway portion 138 is in alignment with the surface of bore 24 to provide an uninterrupted or unrestricted bore 24 as seen in FIG. 5. In this position, air flow into the engine is unobstructed and a wide open running condition may be achieved.

To cold start the engine, the handle 132 is rotated 90 degrees. This rotation of the handle 132 rotates the shaft 130 such that the cut away portion 138 rotates into bore 112 and a cylindrical portion of the shaft 130 extends into the bore 24 as seen in FIG. 6. In this position, the shaft 130 restricts the air flow into the engine. The shaft extends into the bore a desired distance such that about fifteen to twenty percent of the bore is restricted and preferably about twenty percent of the bore is restricted. In the case where a primer is used like that disclosed in U.S. Pat. Nos. 4,793,951 and 4,684,485, a metered amount of fuel would be present in the carburetor and the starting aid 110 would partially restrict the air flow such that the air to fuel ratio is reduced, to provide an enriched amount of fuel at start-up. Once the engine starts and runs, the engine will be able to run at a wide open condition on the lean air mixture. After the engine has passed the warm-up stage, the handle 132 is rotated to where the ball 120 locks in V-notch 136 to provide an unrestricted bore 24, as seen in FIG. 5.

While it will be apparent that the preferred embodiment is well calculated to fulfill the above stated objects, it will also be appreciated that the present invention is susceptible to modification, variation, and alteration without varying from the scope and spirit of the subjoined claims.

What is claimed is:

1. A starting aid for a small internal combustion engine having a carburetor, a carburetor bore operatively associated with the carburetor and defining a longitudinal axis, the bore having one end in communication with a source of combustion air and another end of the bore in communication with a piston cylinder of the internal combustion engine, said starting aid comprising:

shaft means for selectively restricting flow of intake air into said engine, said shaft means adapted to be received by a secondary bore in said carburetor which intersects said carburetor bore; and means for retaining said shaft means in said secondary bore, said retaining means including a biasing means exerting a force on said shaft means for enabling rotation of said shaft means and said biasing means maintaining said shaft means in a first position, where said shaft means is prohibited from obstructing air intake into said carburetor bore, and said shaft means rotatable to a second position, where said shaft means obstructs air into said carburetor bore.

2. The starting aid according to claim 1 wherein said shaft means further comprising an elongated shaft having an arcuate cut out portion and a handle for rotating said shaft.

3. The starting aid according to claim 2 wherein said retaining means further comprising a bore in said carburetor, said biasing means being a spring adapted to be received in said bore, a ball at one end of said spring, and a detent on said shaft associating with said ball for retaining said shaft in said first position.

4. The starting aid according to claim 3 wherein said shaft detent includes an annular groove in said shaft and a V-shaped notch in said annular groove for receiving said ball.

5. The starting aid according to claim 4 wherein boundaries of said annular groove are defined by side walls which retain said shaft from lateral movement.

6. A starting aid for a small internal combustion engine having a carburetor, a carburetor bore operatively associated with the carburetor and defining a longitudinal axis, the bore having one end in communication with a source of combustion air and another end of the bore in communication with a piston cylinder of the internal combustion engine, said starting aid comprising:

a shaft for selectively restricting flow of intake air into said engine, said shaft adapted to be received by a secondary bore in said carburetor which intersects said carburetor bore; and means for retaining said shaft in said secondary bore, said retaining means enabling rotation of said shaft and said retaining means maintaining said shaft in a first position, where said shaft is flush with the wall of the carburetor bore so as to prohibit obstruction of air intake into said carburetor bore, and said shaft is rotatable to a second position, where said shaft obstructs air into said carburetor bore.

* * * * *